United States Patent [19]

Lyman

[11] Patent Number: 4,606,732

[45] Date of Patent: Aug. 19, 1986

[54] INTERLOCKING TOY BUILDING BLOCKS WITH INTERCONNECTING, RELEASABLE HINGES

[76] Inventor: Ronald Lyman, 11140 Squanan River Ct., Rancho Cordova, Calif. 95670

[21] Appl. No.: 621,232

[22] Filed: Jun. 15, 1984

[51] Int. Cl.[4] ..... A63H 33/06; A63H 33/04; A63H 33/12; A63H 33/08

[52] U.S. Cl. ..... 446/120; 446/117; 446/104; 446/128; 59/80

[58] Field of Search ..... 446/85, 102, 104, 108, 446/109, 112, 115, 116, 117, 120, 121, 124, 128, 122, 487; 16/221, 222, 223, 224, 225, 226, 227, 252, 254, 255, 232, 379, 380, DIG. 13; 403/65, 119, 155, 159, 231, 234, 243, 244, 247, DIG. 6; 220/337, 338, 339, 340; 206/386; 63/4, DIG. 3; 59/80

[56] References Cited

U.S. PATENT DOCUMENTS

| | | | |
|---|---|---|---|
| 81,044 | 8/1868 | Pitmann | 403/159 |
| 1,405,851 | 2/1922 | Lewis | 59/80 |
| 1,554,095 | 9/1925 | Hultman | 59/80 |
| 2,776,521 | 1/1957 | Zimmerman | 446/124 X |
| 2,972,833 | 2/1961 | Grutta | 59/80 X |
| 3,005,282 | 10/1961 | Christiansen | 446/128 |
| 3,162,973 | 12/1964 | Christiansen | 446/128 |
| 3,242,610 | 3/1966 | Christiansen | 446/128 |
| 3,603,025 | 9/1971 | Heubl | 446/128 X |
| 4,055,019 | 10/1977 | Harvey | 446/115 |
| 4,090,322 | 5/1978 | Hake | 446/104 |
| 4,185,410 | 1/1980 | Kristiansen | 446/104 |
| 4,214,403 | 7/1980 | Knudsen | 446/104 |
| 4,253,268 | 3/1981 | Mayr | 446/104 |

FOREIGN PATENT DOCUMENTS

| | | | |
|---|---|---|---|
| 0109181 | 5/1984 | European Pat. Off. | 446/124 |
| 2534484 | 4/1984 | France | 446/124 |

*Primary Examiner*—Robert E. Bagwill
*Assistant Examiner*—D. Neal Muir
*Attorney, Agent, or Firm*—Harris Zimmerman; Howard Cohen

[57] ABSTRACT

A toy building block system includes a plurality of blocks, each having an array of cylindrical projections extending from one surface thereof and a like array of socket-like receptacles in the opposite surface for stackable interconnection. In addition, one end of each block includes a pair of hinge arms extending therefrom, with a pair of detent knobs formed on the confronting interior surfaces of the arms. The opposed end of each block includes opposed recessed surface portions, each having a detent recess to receive the knob of a hinge arm of an adjacent block in snap-engaging, pivotting fashion. The blocks thus may be joined end-to-end in pivotting fashion by the hinge arms, as well as stackably in column fashion by the projections and receptacles, or any combination thereof.

40 Claims, 11 Drawing Figures

INTERLOCKING TOY BUILDING BLOCKS WITH INTERCONNECTING, RELEASABLE HINGES

BACKGROUND OF THE INVENTION

The following patents comprise the closest known prior art:

Canada: No.
887,182
USA: Nos.
3,496,670
3,604,145
3,894,354
3,895,456

Generally speaking, there are known in the prior art a large number of toy building block arrangements in which the blocks may be interconnected or adhered to form fanciful structures according to the imagination of the builder and the limitations of the blocks. These blocks often are configured as rectangular prisms, with a top surface having an array of projections extending therefrom, and a bottom surface having a similar array of receptacles adapted to receive and engage the projections of a subjacent block. The limitations of these blocks are related in part to the fact that only the top and bottom surfaces are interconnecting, while the side surfaces impinge mutually but do not adhere. It is thus necessary to construct forms by accretion of vertically stacked arrays of blocks. These arrays may be extended by laterally half-lapping the rows of blocks to form walls, interconnecting the walls in intersecting fashion to create stable structures, and the like. However, it is also necessary to form generally rectilinear structures, due to the perpendicular relationships of the sides of the blocks and to the requirement that only top and bottom surfaces can be joined.

The Canadian patent cited discloses a block arrangement in which some blocks are split and hinged in the middle, apparently to increase the angular structural combinational possibilities. However, this approach does not provide for extended pivotting block structures, nor does it improve on the side-to-side joining of the blocks. Clearly the prior art has not addressed the concept of joining building blocks end-to-end as well as top-to-bottom, nor has it dealt with the concept of pivotal freedom in the end-to-end interconnections.

SUMMARY OF THE PRESENT INVENTION

The present invention generally comprises a toy building block arrangement in which the blocks are adapted to be joined in end-to-end engagement as well as in top-to-bottom stacking engagement. Furthermore, the side-engaging means provides pivotal freedom between laterally adjacent blocks, so that the structures formed by the blocks may include junctions and features extending at virtually any desired angle.

The toy building block system includes a plurality of blocks, each having an array of cylindrical projections extending from the top surface thereof and a like array of socket-like receptacles in the opposing bottom surface. The projections and receptacles are dimensioned for releasable frictional engagement to facilitate stackable interconnection of the blocks. In addition, one end of each block includes a pair of hinge arms extending therefrom coextensively with opposed side panels of the block. The arms are formed as thin, generally semicircular discs, with a pair of bevelled detent knobs formed on the confronting interior surfaces of the discs. The opposed end of each block includes recessed surface portions formed in the same opposed side panels. Each of the recessed portions includes a detent hole adapted to retain the knob of a hinge arm of an adjacent block in snap-engaging, pivotting fashion.

The blocks thus may be joined end-to-end in pivotting fashion by the two hinge arms of one block engaging the detent holes of an adjacent block, reiteratively. The pivotting action is facilitated by the recessed surface portions, which provide clearance for the engaged hinge arms when the blocks are disposed through a wide range of angular relationships. Furthermore, the blocks may be joined stackably in column fashion by the projections and receptacles, or in any combination thereof.

DESCRIPTION OF THE PREFERRED EMBODIMENT

Figure 1:
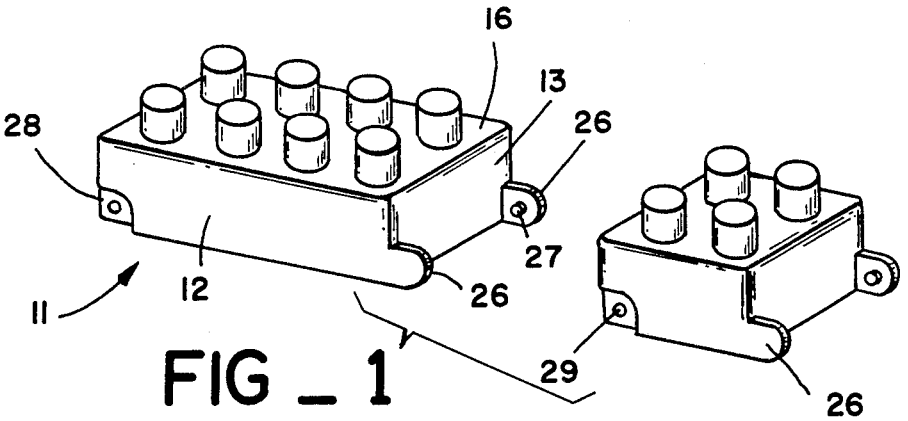
FIG. 1 is a perspective view of two toy building blocks according to the present invention.
Figure 2:
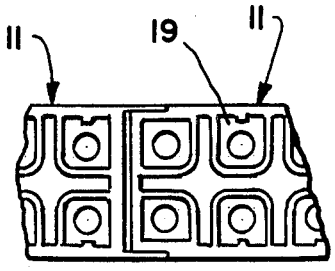
FIG. 2 is a bottom view showing two toy blocks of the present invention in end-to-end engagement.
Figure 3:
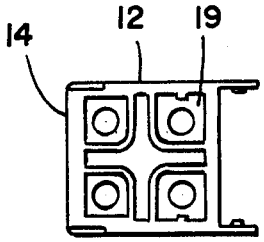
FIG. 3 is a bottom view of a toy block according to the present invention.
Figure 4:
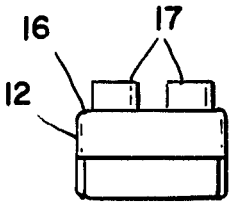
FIG. 4 is an end elevation of a toy block according to the present invention.
Figure 5:
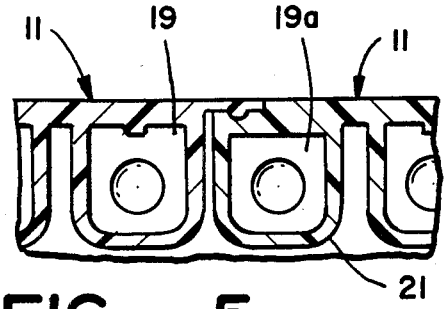
FIG. 5 is an enlarged cross-sectional detailed view of two toy building blocks of the present invention in end-to-end engagement.

The present invention generally comprises a toy building block system in which the blocks may be releasably interconnected laterally as well as vertically. Furthermore, the lateral interconnections of the blocks provide angular and pivotal freedom between the blocks, so that the structures formed by the invention may diverge from the rectilinear forms of prior art toy blocks to designs of virtually any angular configuration.

With reference to the accompanying Figures, the preferred embodiment of the invention includes a plurality of toy building blocks 11, each having the general outer configuration of a right rectangular prism. Each block 11 is formed of opposed, parallel side walls 12 joined integrally to a pair of opposed, parallel end walls 13 and 14. A top wall 16 extends integrally between the upper edges of the side and end walls to close the top of the rectangular form, while the bottom remains open.

Each block 11 also includes a plurality of generally cylindrical projections or bosses 17 extending upwardly from the top wall 16. The projections 17 are disposed in a rectangular matrix array, such as four by two elements, two by two elements, or the like. To connect with such projections in releasable fashion, each block also includes a plurality of socket-like receptacles 19 which are open at the open lower surface of the block. It may be appreciated that the receptacles are disposed in the same rectangular array as the projections extending from the top wall, and that each receptacle has an opening dimensioned to releasably retain by friction one of the identical projections of any other block.

The receptacles 19 are defined by interior panels 21 which extend in depending fashion from the interior surface of the top wall 16. With reference to FIGS. 2, 3, 5, 8, and 11, the interior panels 21 are formed in conjunction with the side and end walls into generally rectangular, hollow tubes having rounded vertices. These tubes may be formed at the corners of the block, each joining a side and end wall and thereby reinforcing the structure. Additionally, if the block is sufficiently long a plurality of receptacles may be defined by the panels 21 formed in U-shape and joined to the side wall 12. In either case, there is generally provided a plurality of protrusions or nubs 22 extending from the side and end walls into the receptacles. Each receptacle 19 includes one protrusion 22 extending from each side or end wall which forms a portion thereof. The protrusions 22 define with the interior panels 21 the dimension of the opening of the receptacles, and this dimension is chosen to provide a slight frictional fit with the cylindrical projections 17.

Figure 8:
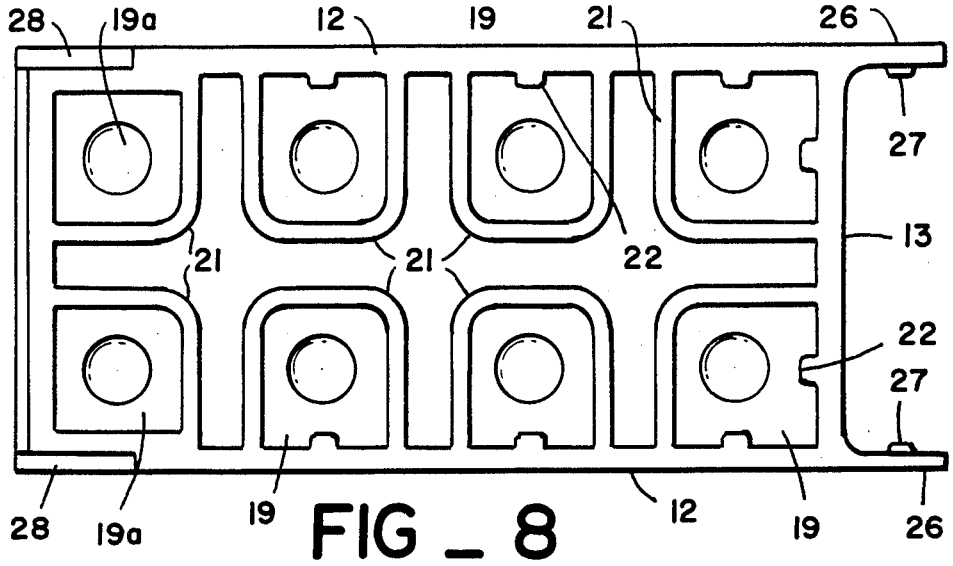
FIG. 8 is an enlarged bottom view of a toy building block of the present invention.
Figure 9:
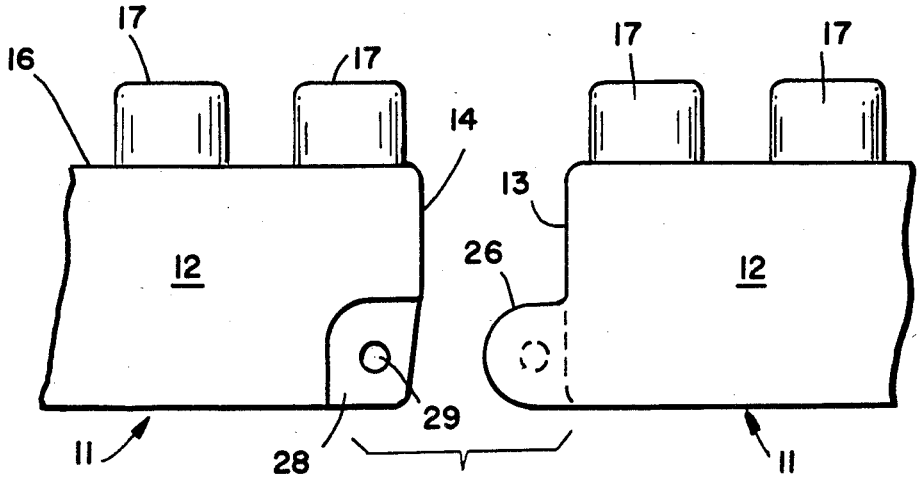
FIG. 9 is a side elevation of a pair of toy blocks of the present invention in end-to-end opposition.

With regard to FIG. 8, each block 11 includes two receptacles 19*a* directly adjacent to the end wall 14 which are not provided with the protrusions 22. Rather, the respective portions of the side and end walls 12 and 14 are thicker at these places, extending into the receptacle opening a distance equal to the height of the protrusions. Thus the effective opening dimension of the receptacles 19*a* is the same as that of the receptacles 19. The design of the receptacles 19*a* is explained in the following.

A significant feature of the present invention is the provision of means to join the blocks 11 in end-to-end engagement as well as the vertical stacking engagement provided by the projections and receptacles 17 and 19. Each block includes a pair of opposed hinge arms 26 extending therefrom outwardly of the end wall 13 and generally coplanar with the side walls 12. The arms 26 are short, thin and planar, with semicircular distal ends. Each arm 26 includes a detent knob 27 extending inwardly from the interiorly opposed surface thereof. Each detent knob 27 is formed as a shallow disc having a flared or bevelled sidewall, as best shown in FIG. 8. It should be noted that the knob 27 is centered with respect to the semicircular end of the respective arm.

Figure 6:
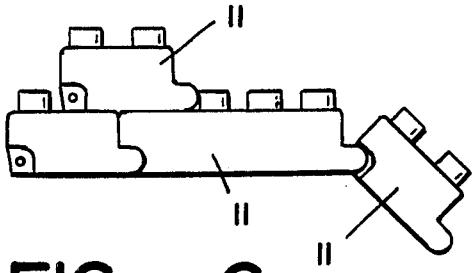
FIG. 6 is a side elevation of a plurality of toy blocks of the present invention in end-to-end and top-to-bottom engagement.
Figure 7:
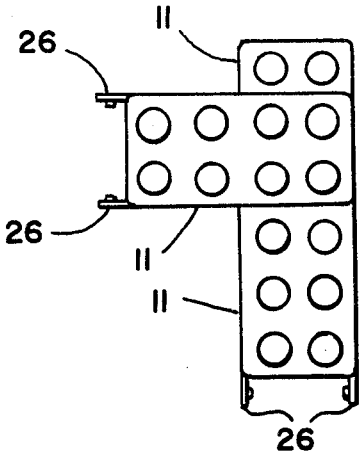
FIG. 7 is a top view of two blocks of the present invention engaged top-to-bottom and aligned at right angles.

In conjunction with the hinge arms, each block 11 also includes a pair of recessed surface portions 28 formed in the lower corners defined by the side walls 12, the end wall 14, and the bottom of the block. The depth of the recesses is equal to the thickness of the hinge arms 26, so that hinge arms may be received in adjacent recesses in flush relationship with the side walls 12. A detent recess 29 is formed in the center of each portion 28, the recess having a diameter and depth sufficient to receive a detent knob 27 of another block in freely rotating fashion. The hinge arms 26 are adapted to flex elastically and diverge outwardly, so that the opposed knobs 27 of a block may clear the recessed surfaces 28 of an adjacent block and snap into the detent recesses 29. The two blocks are thus joined in a side-to-side engagement, as shown in FIG. 6, which is releasable by snapping the knobs out of the recesses 29.

It should be noted that the semicircular ends of the hinge arms, together with the clearance provided by the recesses 29, provides an angularly variable interconnection between any two blocks. To facilitate smooth angular excursions about an axis defined by the two recesses 29, the end wall 14 may be bevelled inwardly from top to bottom, so that the end wall 13 of a block connected thereto will clear the lower corner of the wall 14 during rotation from abutting impingement. Likewise, the end wall 13 may also be bevelled. However, if it is desired to limit or restrict the rotatability of the connected blocks, the end walls 13 and 14 may be formed at right angles to the top and bottom.

It should be noted that the receptacles 19*a* are formed without protrusions 22 due to the proximity of the recessed surface portions 29, and the detent recesses 29. The side wall is thicker at these places, rather than using protrusions 22, to maintain the strength of the side wall.

Figure 10:
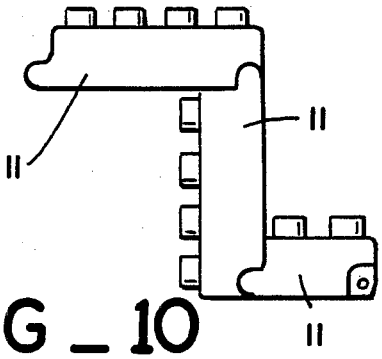
FIG. 10 is a side elevation showing a plurality of toy blocks of the present invention connected end-to-end in inverted relationship and pivotted at right angles.
Figure 11:
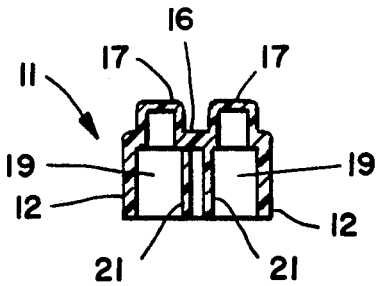
FIG. 11 is a cross-sectional end elevation of a toy block of the present invention.

With regard to FIG. 10, the hinged interconnections of the present invention are designed so that the blocks may be joined in inverted, end-to-end engagement. The semicircular nature of the hinge arms, the clearance of the recessed portions 28, and the centered position of the knobs 27 all combine to permit inverted, pivotally hinged connections, thus further increasing the structural combinations to be made with the toy block system of the present invention.

The form of the preferred embodiment is well adapted for fabrication by molding plastic material by any of several prior art techniques, so that all of the various components enumerated above are an integral part of the overall structure.

It should be noted that the hinged, pivotting side interconnection system of the present invention may be employed with blocks which use interconnecting schemes other than the projections and receptacles 17 and 19 for vertical interconnections. Indeed, the end-to-end interconnecting arrangement of the present invention is an independent adjunct to the top-to-bottom interconnecting means.

I claim:

1. A toy building block system, comprising; a plurality of blocks, each having first interconnection means extending from one exterior face thereof and second interconnecting means extending from an opposed exterior face, said first and second interconnecting means being mutually engagable in releasable frictional engagement with second and first interconnecting means of other like blocks for stackable interconnection therebetween in a longitudinal direction, third interconnecting means disposed at one end of each block and fourth interconnecting means disposed at an opposite end, said third and fourth interconnecting means being mutually engagable in releasable frictional engagement with fourth and third interconnecting means of other blocks for end-to-end interconnection therebetween, and means for providing substantial pivoting angular movement between said mutually engaged third and fourth interconnecting means about an axis generally orthogonal to said longitudinal direction and offset laterally from said exterior faces.

2. The toy building block system of claim 1, wherein said third interconnecting means includes a pair of spaced apart arms extending from said one end of each block.

3. The toy building block system of claim 2, wherein said fourth interconnecting means includes means for engaging said spaced apart arms of another block in releasable, snap-engaging fashion.

4. The toy building block system of claim 3, wherein said spaced apart arms extend in generally parallel fashion from said one end, and wherein the last mentioned means includes a pair of detent knobs protruding from mutually confronting surfaces of said arms.

5. The toy building block system of claim 4, wherein said fourth interconnecting means includes a pair of detent recesses formed in said other end and disposed to engage the detent knobs of another similar block.

6. The toy building block system of claim 5, wherein said fourth interconnecting means further includes a pair of recessed surface portions, each surrounding one of said detent recesses and dimensioned to receive one of said spaced apart arms of another similar block.

7. The toy building block system of claim 4, wherein each of said spaced apart arms includes a generally smooth, rounded, disc-like form, and the respective detent knob is centered with respect to said form.

8. A toy building block system of claim 1, further including snap-acting, resilient means for joining said third and fourth interconnecting means in quick connect, quick release fashion.

9. A toy building block system, comprising: a plurality of blocks, each block comprising a generally rectangular solid form having a top, bottom, opposed side walls and first and second end walls extending therebetween, each block having first interconnection means at said top and second interconnecting means at said bottom, said first and second interconnecting means being mutually engagable in releasable frictional engagement with second and first interconnecting means of other like blocks for stackable interconnection therebetween, third interconnecting means generally disposed directly adjacent to the intersection of said first end wall and said bottom of each block and fourth interconnecting means generally disposed directly adjacent to the intersection of said second end wall and said bottom, and said third and fourth interconnecting means being mutually engagable in freely pivoting, releasable frictional engagement with fourth and third interconnecting means of other blocks for end-to-end interconnection therebetween.

10. The toy building block system of claim 9, wherein said third interconnecting means includes a pair of arms extending outwardly of said first end wall in spaced apart, parallel fashion.

11. The toy building block system of claim 10, wherein said arms extend generally coplanarly with said opposed side walls.

12. The toy building block system of claim 10, wherein said arms are disposed adjacent to the corners defined by said side walls, said first end wall, and said bottom.

13. The toy building block system of claim 11, further including a pair of detent knobs, each extending from one of said arms, said fourth interconnecting means including means for engaging said detent knobs in snap fashion.

14. The toy building block system of claim 13, wherein said arms include generally semicircular distal end portions.

15. The toy building block system of claim 14, wherein said knobs extend from opposing interior surfaces of said arms, and said fourth interconnecting means includes a pair of recessed surface portions formed in said side walls adjacent to said second end wall, each of said recessed surface portions being dimensioned to receive a substantial portion of one of said arms therein.

16. The toy building block system of claim 15, wherein the depth of said recessed surface portions is generally equal to the thickness of said arms, said arms each being in generally flush relationship with the side wall of the respective recessed surface portion.

17. The toy building block system of claim 15, further including a pair of detent recesses, each disposed in one of said recessed surface portions and adapted to receive one of said detent knobs in snap-engaging, freely rotating fashion.

18. The toy building block system of claim 15, wherein each of said knobs is disposed at the center of the respective semicircular distal end portion of the respective arm.

19. The toy building block system of claim 17, wherein two blocks joined by said third and fourth means are angularly rotatable about an axis extending through said detent recesses and coincidently through said detent knobs.

20. The toy building block system of claim 19, wherein at least one of said end walls is bevelled inwardly from top to bottom to provide clearance for said end walls in rotation about said axis.

21. The toy building block system of claim 9, wherein said first interconnecting means includes a plurality of projections extending upwardly from said top in a regular array, and said second interconnecting means includes a like plurality of socket-like receptacles formed at said bottom in a like regular array, said receptacles being adapted to frictionally engage the projections of any other block.

22. A toy building block, comprising; a pair of spaced apart side walls, first and second end walls and a top wall extending therebetween to define a generally rectangular solid, said solid having a generally hollow interior and an open bottom, a plurality of projections extending upwardly from said top wall and disposed in a regular array, a plurality of interior panel members extending from the interior surface of said top wall toward said bottom opening, said interior panel members extending generally perpendicularly to said top wall and disposed to define a plurality of receptacles in conjunction with said side and end walls, said receptacles being dimensioned to receive said projections in releasable frictional engagement, a pair of arms coextensive with said side walls and extending outwardly of said first end wall, a pair of recessed surface portions disposed in said side walls adjacent to said second end wall, said recessed portions being adapted to receive said arms of a like block, a pair of detent recesses, each disposed in one of said recessed surface portions, and a pair of detent knobs, each extending from one of said arms and dimensioned to be received in one of said detent recesses of a like block in freely rotating, snap-engaging fashion.

23. The toy building block of claim 22, wherein said arms extend generally coplanarly with said opposed side walls.

24. The toy building block of claim 22, wherein said arms are disposed adjacent to the corners defined by said side walls, said first end walls, and said bottom.

25. The toy building block of claim 22, wherein said arms include generally semicircular distal end portions.

26. The toy building block of claim 22, wherein the depth of said recessed surface portions is generally equal to the thickness of said arms, said arms each being in generally flush relationship with the side wall of the respective recessed surface portion.

27. The toy building block of claim 25, wherein each of said knobs is disposed at the center of the respective semicircular distal end portion of the respective arm.

28. The toy building block of claim 22, wherein two blocks joined by said arms and recessed surface portions are angularly rotatable about an axis extending through said detent recesses and coincidently through said detent knobs.

29. The toy building block of claim 28, wherein at least one of said end walls is bevelled inwardly from top to bottom to provide clearance for said end walls in rotation about said axis.

30. The toy building block of claim 22, wherein said arms, recessed surface portions, detent recesses and recess knobs provide snap-acting, resilient means for joining a plurality of said blocks in quick connect, quick release fashion.

31. A toy building block system, comprising; a plurality of blocks, each having first interconnection means extending from one exterior face thereof and second interconnecting means extending from an opposed exterior face, said first and second interconnecting means being mutually engagable in releasable frictional engagement with second and first interconnecting means of other like blocks for stackable interconnection therebetween to form a stack extending in a nominal plane, third interconnecting means disposed at one end of each block and fourth interconnecting means disposed at an opposite end of each block, said third and fourth interconnecting means being mutually engagable in releasable frictional engagement with fourth and third interconnecting means of other blocks for end-to-end interconnection therebetween in said nominal plane, and means for providing substantial rotational angular movement within said nominal plane between said mutually engaged third and fourth interconnecting means.

32. The toy building block system of claim 31, wherein said third interconnecting means includes a pair of spaced apart arms extending from said one end of each block.

33. The toy building block system of claim 32, wherein said fourth interconnecting means includes means for engaging said spaced apart arms of another block in releasable, snap-engaging fashion.

34. The toy building block system of claim 33, wherein said spaced apart arms extend in generally parallel fashion from said one end, and wherein the last mentioned means includes a pair of detent knobs protruding from mutually confronting surfaces of said arms.

35. The toy building block system of claim 34, wherein said fourth interconnecting means includes a pair of detent recesses formed in said other end and disposed to engage the detent knobs of another similar block in snap-engaging, freely rotating fashion.

36. The toy building block system of claim 35, wherein said fourth interconnecting means further includes a pair of recessed surface portions, each surrounding one of said detent recesses and dimensioned to receive one of said spaced apart arms of another similiar block.

37. The toy building block system of claim 34, wherein each of said spaced apart arms includes a generally smooth, rounded, disc-like form, and the respective detent knob is centered with respect to said form.

38. The toy building block system of claim 36, wherein the depth of said recessed surface portions is generally equal to the thickness of said arms, said arms each being in generally flush relationship with the side wall of the respective recessed surface portion.

39. The toy building block system of claim 37, wherein two blocks joined by said third and fourth means are angularly rotatable about an axis extending through said detent recesses and coincidentally through said detent knobs.

40. The toy building block system of claim 39, wherein at least one of said ends is bevelled inwardly from top to bottom to provide clearance for said ends in rotation about said axis.

* * * * *